US006544352B2

(12) United States Patent
Mitani et al.

(10) Patent No.: US 6,544,352 B2
(45) Date of Patent: Apr. 8, 2003

(54) METHOD FOR THE COMPACTION OF SOFT MAGNETIC POWDER

(75) Inventors: Hiroyuki Mitani, Kobe (JP); Takehiro Tsuchida, Kobe (JP); Yuichi Seki, Kobe (JP); Akihiko Kagawa, Takasago (JP); Tetsuya Sawayama, Takasago (JP); Yoshikazu Seki, Takasago (JP); Masaaki Sato, Takasago (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/870,827

(22) Filed: Jun. 1, 2001

(65) Prior Publication Data

US 2002/0189714 A1 Dec. 19, 2002

(51) Int. Cl.[7] ..... H01F 1/24

(52) U.S. Cl. ..... 148/104; 419/23; 419/35; 419/64; 419/65

(58) Field of Search ..... 148/104; 419/64, 419/65, 23, 35

(56) References Cited

U.S. PATENT DOCUMENTS

| | | | | |
|---|---|---|---|---|
| 3,901,742 A | | 8/1975 | Facaros | |
| 4,006,016 A | | 2/1977 | Zambrow et al. | |
| 4,265,681 A | * | 5/1981 | Krause et al. | 148/111 |
| 5,798,177 A | * | 8/1998 | Jansson | 428/403 |
| 5,977,033 A | | 11/1999 | Lefebvre et al. | |
| 5,980,603 A | | 11/1999 | Thomas et al. | |
| 5,993,729 A | * | 11/1999 | Lefebvre et al. | 419/2 |
| 6,190,605 B1 | | 2/2001 | Cadle et al. | |

FOREIGN PATENT DOCUMENTS

| | | |
|---|---|---|
| JP | 59-50138 | 3/1984 |
| JP | 3-25278 | 4/1991 |
| JP | 7-245209 | 9/1995 |
| JP | 8-260114 | 10/1996 |
| JP | 2710152 | 10/1997 |
| JP | 9-272901 | 10/1997 |

OTHER PUBLICATIONS

E. Klar, et al., ASM Handbook, Formerly Ninth Edition, Metals Handbook, vol. 7, pps. 306–307, "Powder Metallurgy," 1984.

* cited by examiner

*Primary Examiner*—John Sheehan
(74) *Attorney, Agent, or Firm*—Oblon, Spivak, McClelland, Maier & Neustadt, P.C.

(57) ABSTRACT

Disclosed is a method for the compaction of a soft magnetic powder capable of manufacturing a green compact which has attained high density and high strength, is excellent in mechanical properties and magnetic properties, and does not cause a reduction in electrical resistance. Soft magnetic powder particles individually surface-coated with an insulating vitreous layer containing P, Mg, B, and Fe as essential components are used, and a lubricant is applied to the inner wall surface of a compaction die. The soft magnetic powder is subjected to compaction at from not less than room temperature to less than 50° C. without mixing the lubricant with the soft magnetic powder, followed by annealing at from 50 to 300° C.

10 Claims, 4 Drawing Sheets

METHOD FOR THE COMPACTION OF SOFT MAGNETIC POWDER

BACKGROUND OF THE INVENTION

1. Field of the Invention

The present invention relates to a method for manufacturing a green compact useful as a material for a high frequency dust core by compacting a soft magnetic powder such as an iron powder or an iron base alloy powder. More particularly, it relates to a compaction method capable of enhancing the green density, and further improving the mechanical properties, magnetic properties, and the like of the final green compact.

2. Description of the Prior Art

In recent years, there has been used a green compact obtained by compacting a soft magnetic powder such as an iron powder or an iron base alloy powder (below, may be typically referred to as "iron powder") as a material for a high frequency dust core. In order to enhance the mechanical properties and magnetic properties of such a green compact, it is important to increase the density and the strength as high as possible. Various technologies have been proposed heretofore from such a viewpoint of attaining higher density and higher strength.

For example, JP-A-No. 50138/1984 proposes a dust core material obtained by coating each particle of an iron powder with an organic binder such as an epoxy resin or a fluorocarbonresin. With this technology, the strength can be improved to a certain degree by mixing a resin therein. However, the improvement ratio of the strength is determined by the characteristics of the resin itself. Therefore, the resulting strength does not reach the level capable of sufficiently satisfying the recent demand for higher strength. Whereas, when a resin is mixed with the iron powder, the volume fraction of the iron powder decreases by the amount of the resin mixed. Accordingly, the green density decreases at least by the amount of the resin added relative to the green density for 100% iron powder. The resin is required to be added in such an amount as to sufficiently coat around the particles of the iron powder for improving the strength. However, the density of the green compact decreases correspondingly, so that the magnetic properties of the green compact such as the magnetic flux density or the magnetic permeability remain unsatisfactory.

Whereas, in JP-A-No. 245209/1995, there is proposed a technology for improving the strength of a green compact by using an iron powder which has been subjected to surface phosphating in place of the organic binder coating used in JP-A-No. 50138/1984. However, with this technology, the strength is improved more than when only an iron powder is compacted due to the effect of the phosphating treatment. Nevertheless, the effect of the strength improvement is less as compared with the case where an organic binder is coated thereon as disclosed in JP-A-No. 50138/1984. Further, with the compaction method as disclosed in JP-A-NO. 245209/1995, a lubricant is required to be pre-mixed with an iron powder from the viewpoint of preventing the seizure between a green compact and a compaction die. Accordingly, the volume fraction of the iron powder decreases by the amount of the lubricant added. As a result, the green density decreases at least by the amount of the lubricant added relative to the green density for 100% iron powder. Therefore, this technology is not sufficiently adaptable to the recent demand for further higher density and higher strength, either.

Further, for example, in JP-A-No. 272901/1997, there is also proposed a technology in which a lubricant is not mixed with an iron powder, but applied onto only the inner wall surface of a compaction die, followed by (warm) compaction at a temperature of from 150 to 400° C. This method is a so-called die wall lubrication method. The iron powder basically contains no lubricant not resin for coating the organic binder, resulting in no occurrence of the reduction in green density due to mixing thereof as described above. However, even if such a die wall lubrication method is applied to a conventional soft magnetic powder, in actuality, the strength improvement is not achieved as much as expected.

On the other hand, a study has also already been underway from the viewpoint of improving the magnetic properties of the green compact. For example, such a technology as disclosed in Japan Patent No. 2710152 is proposed. With this technology, the particles of an iron powder individually coated with an insulating vitreous layer containing P, Mg, B, and Fe as essential components are used. The starting powder and a lubricant are mixed for compaction, followed by annealing at a temperature of from 400 to 600° C. for achieving joining between the insulating vitreous layers, thereby improving the insulating property and the magnetic flux density. Japan Patent No. 2710152 discloses that the strength improvement can also be accomplished by mixing a resin therewith as shown in JP-A-No. 50138/1984 in addition to coating thereof with the insulating vitreous layer in such a manner.

Subsequent study by the present inventors proves as follows. In the technology of Japan Patent No. 2710152, in addition to the strength improvement effect due to mixing of a resin, the insulating vitreous layers join together during the process of from compaction to annealing to contribute to the strength improvement of the green compact. As a result, the green compact strength is improved more than when only a resin is mixed. However, since the lubricant and the resin are mixed therein, the volume fractions of the iron powder decreases by at least the amount thereof. As a result, the green density decreases relative to the green density for 100% iron powder, still resulting in unsatisfactory circumstances for responding to the recent demand for further higher density. Further, with the technology of Japan Patent No. 2710152, annealing after compaction is carried out at from 400 to 600° C. However, when annealing is carried out at such a high temperature, joining between the insulating vitreous layers further proceeds to improve the strength of the green compact, but the electric resistance is decreased as described below, presenting another problem that the resulting green compact is not applicable to a part required to have a high electric resistance.

On the other hand, other than the foregoing technologies, there is also proposed a technology of promoting densification of a powder by applying vibrations to the powder at a stage of compaction (ex. JP-B-Nos. 25278/1991, 6549/1966, and 5414781/1966). Further, the present inventors also proposes that use of an iron powder flattened so that the ratio of the mean particle size to the thickness is 4 or more is effective for high densification (JP-A-No. 260114/1996). However, only these technologies are insufficient for accomplishing higher density and higher strength of the green compact.

SUMMARY OF THE INVENTION

The present invention has been achieved in view of the foregoing circumstances. It is therefore an object of the present invention to provide a method for the compaction of a soft magnetic powder capable of manufacturing a green compact which as attained higher density and higher strength than ever without causing a reduction in electric resistance.

The present invention which has attained the foregoing object pertains to a method for the compaction of a soft magnetic powder, comprising: applying a lubricant to the inner wall surface of a compaction die, and subjecting the soft magnetic powder to compaction at from not less than room temperature to less than 50° C. without mixing the lubricant with the soft magnetic powder, and then annealing a resulting green compact at from 50 to 300° C., particles of the soft magnetic powder being individually surface-coated with an insulating vitreous layer containing P, Mg, B, and Fe as essential components.

The object of the present invention can also be attained by using soft magnetic powder particles individually surface-coated with an insulating vitreous layer containing P, Mg, B, and Fe as essential components, applying a lubricant to the inner wall surface of a compaction die, and subjecting the soft magnetic powder to compaction at from not less than 50° C. to less than 250° C. without mixing the lubricant with the soft magnetic powder.

In the method of the present invention, it is appropriate that the pressure at the time of compaction is from 250 to 1500 MPa. If the maximum pressure at the time of compaction is set at from 500 to 1500 MPa, and vibrations are applied to the compaction die, the vibration in a pressure-free condition is set to have a single amplitude of 0.002 to 0.20 mm, and the amplitude of the vibration for all or a part of the time during which the compaction pressure is 500 MPa is not less than 20% of the amplitude in the pressure-free condition, preferably, higher densification of the green compact is attained. In such a method in which vibrations are applied, it is preferable that the frequency of the vibration is set at from 5 Hz to 20 kHz. Further, the soft magnetic powder to be used in the present invention preferably has a ratio (d/t) of the mean particle size d to the thickness t of not less than 4.

DETAILED DESCRIPTION OF THE PREFERRED EMBODIMENTS

Figure 1:
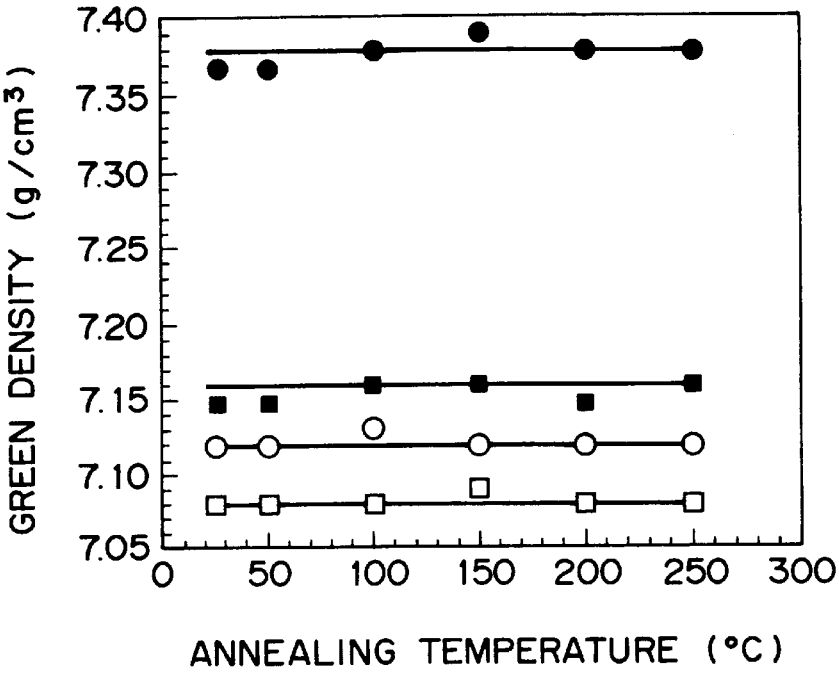
FIG. 1 is a graph showing the relationship between the annealing temperature and the green density when compaction is carried out under various conditions.

The present inventors have conducted intensive studies from various angles in order to attain the higher density and higher electric resistance of a green compact. As a result, they have found that, if particles of a soft magnetic powder each of which is surface-coated with an insulating vitreous layer containing P, Mg, B, and Fe as essential components (below, may be referred to as "insulated powder") are subjected to die wall lubrication compaction without mixing a lubricant therewith, followed by warm joining treatment (annealing), or warm compaction combining compaction and a joining treatment, the foregoing object is successfully attained. Thus, they have completed the present invention.

The insulated powder to be used in the present invention are composed of particles each surface-coated with an insulating vitreous layer containing P, Mg, B, and Fe as essential components. Such a powder can be obtained by mixing a phosphoric acid, boric acid, and magnesium oxide aqueous solution with a high purity iron powder, and drying the mixture (Japan Patent No. 2710152). Further, although the powder has no particular restriction as to the particle size and form, the ratio (d/t) of the mean particle size d to the thickness t is preferably not less than 4. By using such a powder, it is possible to attain still higher densification.

The insulated iron powder has often been mixed with a lubricant in order to prevent the seizure with a compaction die, and a resin has often been mixed in the powder from the viewpoint of further improving the strength (Japan Patent No. 2710152). However, as described above, when the lubricant and the resin are mixed therein, the volume fraction of the iron powder decreases by the amount of the resin, impeding the further improvement of magnetic properties such as magnetic flux density and the magnetic permeability. Therefore, it is not preferred in terms of the magnetic properties that materials other than the magnetic powder are mixed. For this reason, in the method of the present invention, compaction is carried out by a so-called die wall lubrication, in which a lubricant is applied onto the inner wall surface of a compaction die without mixing the lubricant or a resin in the soft magnetic powder.

In the present invention, as described above, a lubricant is not mixed with the soft magnetic powder, but the lubricant is required to be applied at least onto the inner wall surface of a compaction die. This is for preventing the seizure between the inner wall of the compaction die and the powder. Use of the lubricant in such a manner will not adversely affect the characteristics of a green compact. In the present invention, the type of the lubricant to be applied onto the inner wall surface of the compaction die has no particular restriction. Typical examples thereof include metallic salts of stearic acid (ex., calcium stearate, zinc stearate, and lithium stearate). These may be applied still in the powder form, or dissolved in an organic solvent to be applied. Further, other than the foregoing lubricants, any lubricants such as graphite and molybdenum disulfide may be applied so long as they have lubricity.

By merely compacting the insulated vitreous layers at a temperature of from not less than room temperature to less than 50° C., the layers are joined through physical contact therebetween to improve the strength. By setting the compaction temperature at not less than 50° C., the joining between layers proceeds, so that the further improvement of the strength is observed (this will be described below).

The present inventors have manufactured iron powder particles each surface-coated with an insulating vitreous layer containing P, B, Mg, and Fe as essential components in the following manner. Namely, an insulated solution comprising a mixed solution containing 163 g of phosphoric acid, 31 g of MgO, and 30 g of boric acid per liter of water was prepared. The resulting insulated solution was added and mixed in an amount of from 0.05 to 30 cc per 100 g of a high purity iron powder. Then, the resulting mixture was dried at a temperature of not more than 300° C. for 20 minutes, followed by grinding, resulting in an insulated powder.

Figure 2:
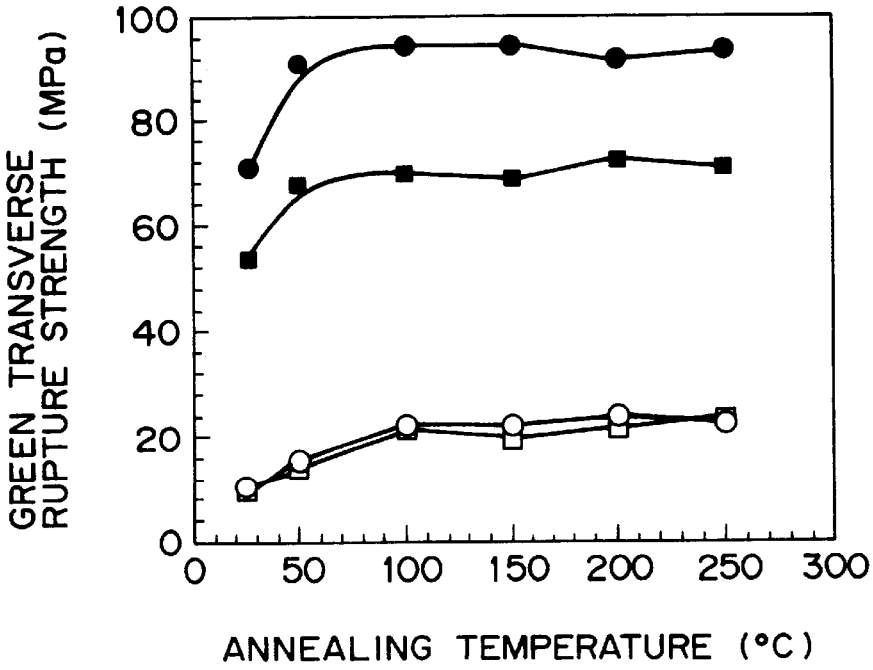
FIG. 2 is a graph showing the relationship between the annealing temperature and the green transverse rupture strength of a green compact when compaction is carried out under various conditions.
Figure 3:
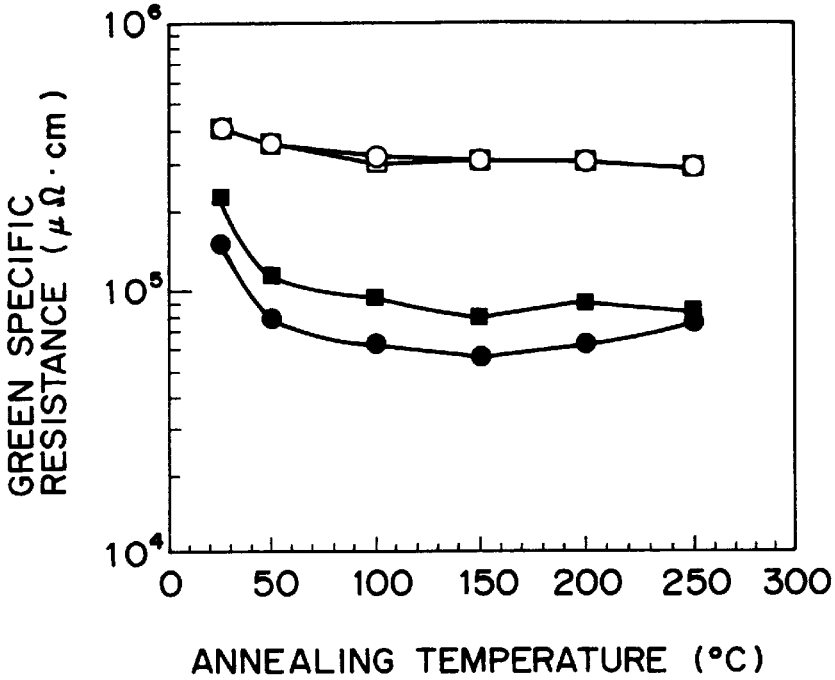
FIG. 3 is a graph showing the relationship between the annealing temperature and the green specific resistance of a green compact when compaction is carried out under various conditions.

The present inventors have conducted compaction at ordinary temperatures under various conditions by using the insulated powder, and then subjected the resulting green compact to annealing in an air at a temperature in the range of from room temperature to 250° C. Then, they have conducted a study on the influences of the annealing temperature on the density, transverse rupture strength, specific resistance, and the like of the green compact. The results are shown in FIGS. 1 to 3. It is noted that FIGS. 1 to 3 also show the results when a lubricant is mixed with a conventional uninsulated iron powder, and the mixture is compacted. Further, the conditions under which the results indicated with respective marks ■, ●, □, and ○ in FIGS. 1 to 3 are obtained are as follows:

■: Die wall lubrication compaction (molybdenum disulfide is applied onto the compaction die inner wall surface, compaction surface pressure: 700 Mpa)

●: Die wall lubrication compaction (molybdenum disulfide is applied onto the compaction die inner wall surface, compaction surface pressure: 1000 Mpa)

□: Lubricant mixing (lithium stearate is mixed in an amount of 0.75 mass % with an iron powder, compaction surface pressure: 700 Mpa)

○: Lubricant mixing (lithium stearate is mixed in an amount of 0.75 mass % with an iron powder, compaction surface pressure: 1000 Mpa)

FIG. 1 is a graph showing the relationship between the annealing temperature and the green density. The graph indicates that, although the annealing temperature less affects the green density, the green density becomes large for the green compact obtained by die wall lubrication compaction.

FIG. 2 is a graph showing the relationship between the annealing temperature and the green transverse rupture strength of a green compaction. As apparent from the results, the transverse rupture strength increases with an increase in the annealing temperature, and the green compact obtained from die wall lubrication compaction relatively has a higher transverse rupture strength. This is considered to be attributable to the following fact. Namely, by subjecting iron powder particles each having an insulating vitreous layer to die wall lubrication compaction, the contact area between the insulating vitreous layers concerning joining increases, so that the transverse rupture strength increases accordingly. In contrast, for the green compact obtained by mixing a lubricant with an iron powder, and compacting the mixture, the transverse rupture strength is low. This is considered to be attributable to the following fact. Namely, the lubricant intervenes between iron powder particles, resulting in a reduced strength.

As apparent from the results of FIGS. 1 and 2, for a green compact obtained by compacting iron powder particles each surface-coated with the insulating vitreous layer by die wall lubrication without mixing a lubricant therewith, a higher density is attained as compared with the case where compaction is carried out by mixing a lubricant therewith. When such a green compact is further subjected to annealing at a temperature of not less than 50° C., more excellent strength improvement effect is obtained than when the green compact formed by mixing the lubricant therewith is annealed. Incidentally, it has been also confirmed that a high magnetic permeability (about 100 to 150) is obtained in the green compact obtained in accordance with the present invention.

FIG. 3 is a graph showing the relationship between the annealing temperature and the green specific resistance when compaction is carried out under various conditions. As apparent from the result, in the green compact obtained by die wall lubrication compaction, the specific resistance is decreased because no lubricant is mixed in the powder, but it is not decreased so much as compared with the one obtained by mixing the lubricant therein. Thus, if the difference in specific resistance therebetween is at this level, it is conceivable that the eddy current loss is not changed so much.

Figure 4:
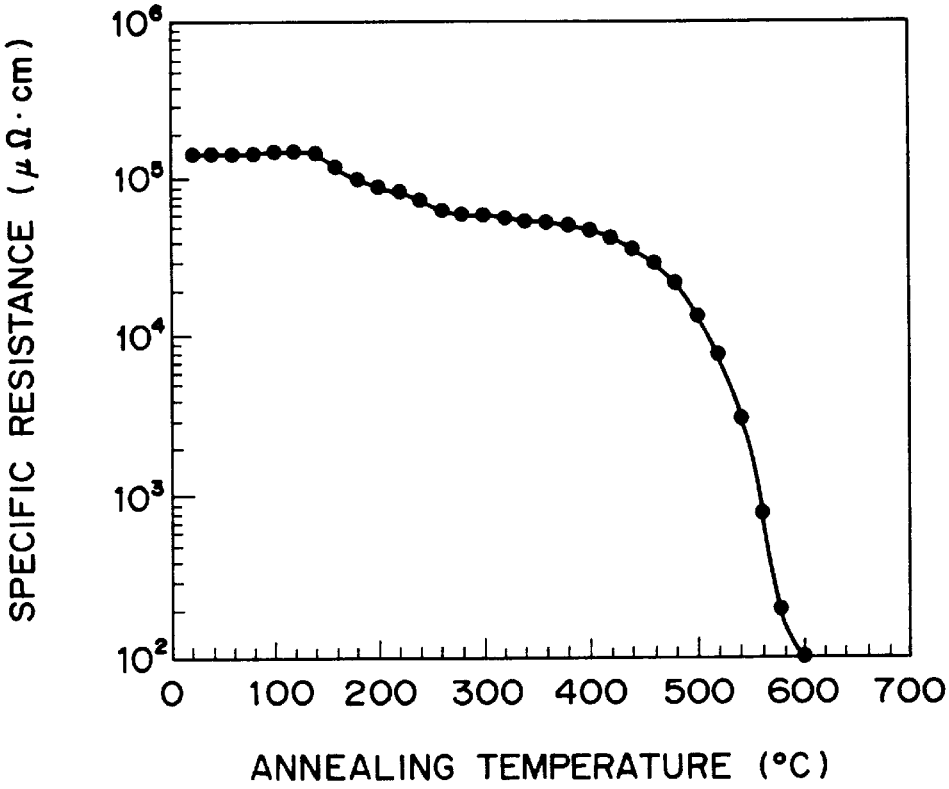
FIG. 4 is a graph showing the influence of the annealing temperature on the specific resistance of the green compact when the annealing temperature is increased.

The present inventors have further conducted a study on the influence of the annealing temperature on the specific resistance of the green compact when the annealing temperature is increased under the conditions indicated by a mark "●" of FIGS. 1 to 3. The result is shown in FIG. 4, indicating that the specific resistance of the green compact begins to decrease remarkably when the annealing temperature exceeds 300° C. For this reason, in the present invention, the upper limit of the annealing temperature after compaction is set at 300° C. The annealing temperature is set at preferably 250° C. or less, more preferably 200° C. or less, and most preferably 150° C. or less from the viewpoint of suppressing the reduction in specific resistance.

The reason why the specific resistance is decreased by setting the annealing temperature relatively high can be considered as follows. Namely, although the insulating vitreous layer itself exhibits a relatively high electric resistance, it remarkably undergoes modification when annealing is carried out at high temperatures, so that oxygen in the layer is diffused into the iron powder to form magnetite on the surfaces of the iron powder particles, resulting in a reduction in electric resistance. Such a reduction in electric resistance incurs a reduction in iron loss. This does not present a very serious problem for a conventional soft magnetic material, but presents a problem for a magnetic core material required to have such a high electric resistance as to enable the reduction of a eddy current loss when used with alternating current.

As described above, in the present invention, it is necessary that the iron powder particles individually coated with insulating vitreous layers are compacted at a temperature of from not less than room temperature to less than 50° C. by die wall lubrication, followed by annealing at a temperature in the range of from 50 to 300° C. It is noted that the annealing process also exhibits an effect of releasing the strain at the time of compaction to improve the magnetic permeability of the green compact. A temperature of not less than 50° C. is required also from the viewpoint of exerting such effects. On the other hand, although the annealing temperature is preferably set at a temperature as high as possible from the viewpoint of promoting the joining between the insulating vitreous layers, the reduction of the electric resistance is incurred as described above. Further, in the present invention, since a resin or a lubricant is not added, the green density is increased correspondingly. Further, the contact area between the insulating vitreous layers individually coated on the iron powder particles is increased, so that joining between the insulating layers tends to proceed during compaction and annealing. Accordingly, it is considered that the magnetic properties and the strength are improved even if the annealing temperature is not so high as in Japan Patent No. 2710152. Therefore, by manufacturing the green compact in accordance with the method of the present invention, it is possible to obtain an excellent green compact which has high green density and green strength, and further does not cause a reduction in electric resistance.

In the method of the present invention, for the compaction pressure in carrying out compaction, it is preferably from 250 to 1500 MPa. If the compaction pressure is less than 250 MPa, a sufficient density of the green compact cannot be obtained, so that the characteristics required as a soft magnetic part cannot be obtained. On the other hand, if the compaction pressure exceeds 1500 MPa, there occurs the fear of the breakage of the green compact. It is noted that the compaction pressure is preferably in the range of from about 600 to 1000 MPa.

Further, with the green compact obtained by the method of the present invention, the strength improvement has been accomplished through joining between the layers in the inside of the green compact as described above. Therefore, the strength thereof is hardly affected by the atmosphere at the time of compaction. Accordingly, the green compact may be manufactured either in an air or in an inert gas atmosphere.

The method of the present invention is basically accomplished in the following manner. Namely, compaction is carried out at from not less than ordinary temperatures to less than 50° C., followed by annealing at a temperature in the range of from 50 to 300° C. It is also effective that compaction is carried out by warm compaction within a prescribed temperature range from the viewpoint of attaining a higher densification.

Figure 5:
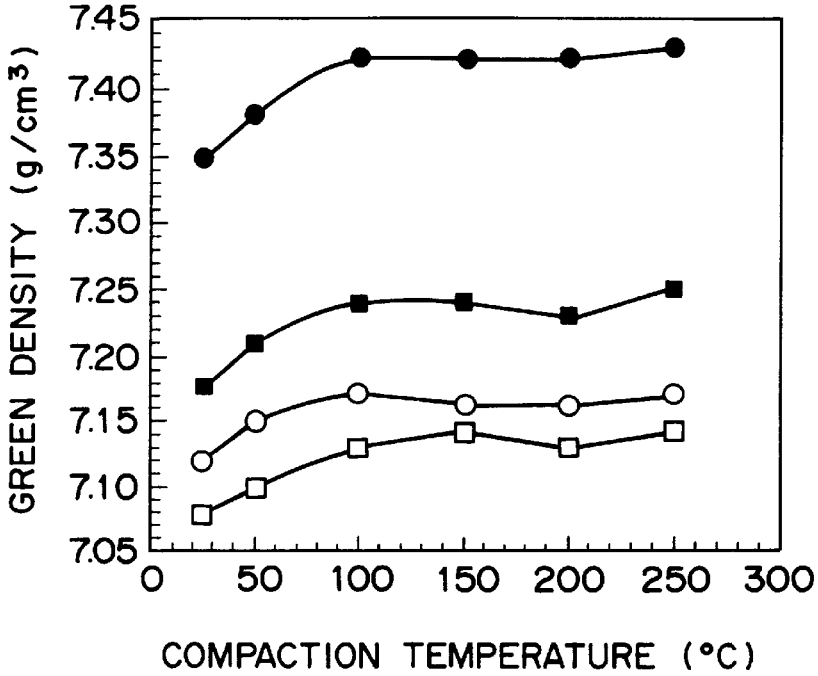
FIG. 5 is a graph showing the relationship between the compaction temperature (warm compaction temperature) and the green density.
Figure 6:
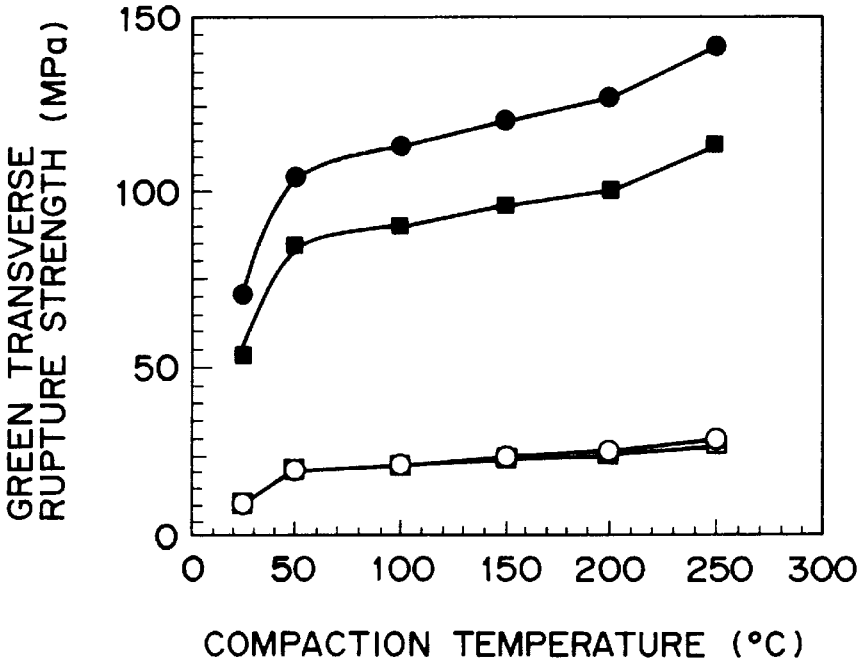
FIG. 6 is a graph showing the relationship between the compaction temperature and the transverse rupture strength of a green compact.
Figure 7:
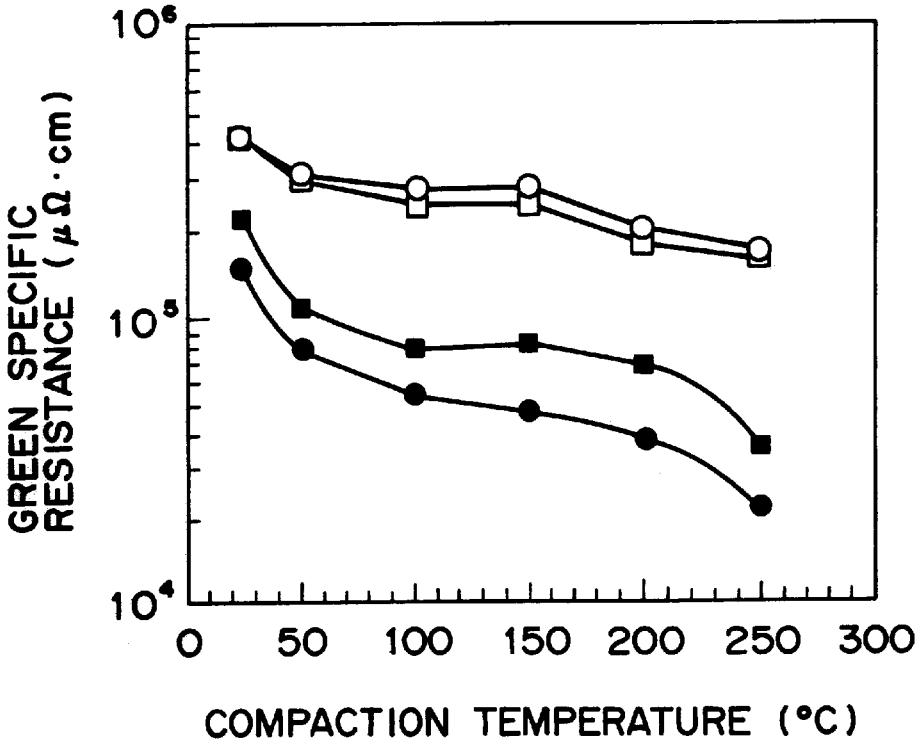
FIG. 7 is a graph showing the relationship between the compaction temperature and the transverse rupture strength of a green compact when compaction is carried out under various conditions.

The present inventors have conducted compaction (warm compaction) at a temperature in the range of from 50 to 250° C. by using the insulated powder. Then, they have conducted a study on the influences of the compaction temperature on the density, transverse rupture strength, specific resistance, and the like of the green compact. The results are shown in FIG. 5 to 7. It is noted that FIGS. 5 to 7 also show the results when a lubricant is mixed with a conventional uninsulated iron powder, and the mixture is compacted. Further, the conditions under which the results indicated with respective mark ■, ●, □, and ○ in FIGS. 5 to 7 are obtained are the same as in the cases of FIGS. 1 to 3.

FIG. 5 is a graph showing the relationship between the compaction temperature (warm compaction temperature) and the green density. The graph indicates that the green density increases with an increase in compaction temperature, and the green compact obtained from die wall lubrication compaction has a higher green density as compared with the green compact compacted by mixing a lubricant therein. Further, as apparent from the comparison with FIG. 1, the green compact obtained from warm compaction has a higher density as compared with the green compact obtained by compacting the powder at ordinary temperatures, and then annealing the compact.

FIG. 6 is a graph showing the relationship between the compaction temperature and the transverse rupture strength of a green compact. As apparent from the results, although the transverse rupture strength increases with an increase in compaction temperature, the green compact obtained from die wall lubrication compaction relatively has a higher transverse rupture strength. Further, as apparent from the comparison with FIG. 2, the green compact obtained from warm compaction has a higher transverse rupture strength as compared with the green compact obtained by compacting the powder at ordinary temperatures, and then annealing the compact.

FIG. 7 is a graph showing the relationship between the compaction temperature and the specific resistance of a green compact when compaction is carried out under various conditions, indicating that the specific resistance begins to decrease remarkably when the compaction temperature is in the vicinity of 250° C. As can be seen from FIGS. 5 to 7, by compacting an insulated powder at a temperature of from not less than 50° C. to less than 250° C. it is possible to obtain an excellent green compact which has high green density and green strength, and further does not cause a reduction in electric resistance. It is noted that the compaction temperature is set at preferably from 50 to 200° C., and more preferably from 50 to 150° C. By performing compaction within such a preferable temperature range, it is possible to accomplish the improvement of the green density and green strength while maintaining a relatively high specific resistance.

The method of the present invention is basically accomplished by compacting an insulated powder without mixing a lubricant therewith, and subjecting the compact to a warm annealing treatment, or subjecting an insulated powder to warm compaction combining compaction and a joining treatment. However, it is preferable that appropriate vibrations are applied during the compaction process because a higher densification of the green compact can be attained. Although it is possible to apply a conventional vibration compaction technique substantially as it is in generating such vibrations, it is preferable that the vibration conditions are controlled as described below because the densification effect due to vibrations is exerted with more efficiency.

Namely, the vibration condition control to be preferably adopted in the present invention is particularly a combination of vibration control for the vibrations to be applied in a pressure-free condition prior to pressing, and control of vibrations applied during pressing. It has been confirmed that the green density of the green compact can be increased more effectively by conducting the vibration control of vibrations described in detail below.

Incidentally, the present inventors have confirmed that, when a powder which undergoes plastic deformation such as an iron powder is compacted, even if vibrations with an enough amplitude are applied in the pressure-free condition with a conventional vibration compaction method, the vibrations are attenuated during pressing, so that the vibrating effect is not exerted effectively.

However, if the single amplitude of vibrations in the pressure-free condition is set in a range of from 0.002 to 0.20 mm, and vibrations with an amplitude which is not less than 20% of, and more preferably not less than 50% of the amplitude in the pressure-free condition are applied during all or a part of the pressing time especially when the pressure is not less than 500 MPa in carrying out compaction at a mixture pressure of from 500 to 1500 MPa, the effects of reducing the frictions between powder particles, and the powder and the compaction die are further enhanced, making it possible to still further enhance the green density.

The reason why the single amplitude of vibrations in a pressure-free condition is set in a range of from 0.002 to 0.20 mm is as follows. Namely, if the amplitude is less than 0.002 mm, the densification effect due to vibrations in the pressure-free condition is not exerted effectively. On the other hand, if the amplitude is excessively increased to more than 20 mm, not only an excess energy becomes necessary for keeping the amplitude, but also the maintenance of equipment becomes difficult. From these viewpoints, the more preferred single amplitude of vibrations in the pressure-free condition is between 0.05 mm and 0.15 mm, both inclusive.

Further, the reason why the amplitude during press compaction is set at not less than 20% of the amplitude in the pressure-free condition is as follows. Namely, if it is less than 20%, the friction reducing effect due to vibration under pressing conditions, and the high densification effect resulting therefrom are not exerted effectively. In order that the high densification effect due to vibrations under pressing conditions is exerted more effectively, it is desirably set at not less than 50% of the amplitude in the pressure-free condition. Whereas, if it is not more than 0.2 mm, whereby it becomes difficult to keep vibrations mainly from the viewpoint of the equipment as described above, it is acceptable that it exceeds 100% of the amplitude in the pressure-free condition.

The means for applying vibrations has no particular restriction. Preferred examples thereof include a method in which vibrations are transmitted to the internal powder through upper and lower punches to be applied to a compaction die, and a method in which vibrations are transmitted thereto from the upper punch or the lower punch alone. Further, it is also effective to adopt a combination of vibrations to a die and vibrations from a punch or the punches. The timing at which vibrations are applied thereto is set at the time when no pressure is applied, and all or a part of the time when a pressure of at least 500 MPa or more is applied. Whether or not vibrations are applied at the time of packing of the starting powder into a compaction die or at the time of removing the green compact from the die is optional.

Further, the fundamental frequency of the vibration to be imposed thereon is set from a range of generally from 5 Hz to 20 kHz, and more preferably from 5 Hz to 200 Hz in order to attain the reduction of the mutual friction between powder particles, and the high densification resulting therefrom. Incidentally, if the fundamental frequency is less than 5 Hz, the mutual friction between powder particles due to application with vibrations cannot be reduced sufficiently. Whereas, in order to apply vibrations with a high frequency of more than 20 kHz under pressing conditions, an excessive energy is required, which is not practical from the viewpoint of the equipment. However, if the amplitudes of frequencies corresponding to integer-fold frequencies thereof are synthesized in a vibration generator, it is needless to say that the utilization of such vibrations with high frequencies is also possible.

Table 1 below shows the influences of the presence or absence of the amplitude at the time of press compaction on the green density, indicating that application of vibrations is effective for the green compact density improvement.

TABLE 1

| Compacting conditions | | | | | | |
|---|---|---|---|---|---|---|
| Compaction temperature (° C.) | Compaction pressure (MPa) | Frequency (Hz) | Amplitude in pressure-free condition (mm) | Amplitude under pressing at 500 MPa (mm) | Green density (g/cm$^3$) | Note |
| 25 | 700 | — | — | — | 7.15 | No vibration |
| 25 | 700 | 50 | 0.05 | 0.04 | 7.21 | Vibration observed |
| 150 | 700 | — | — | — | 7.24 | No vibration |
| 150 | 700 | 50 | 0.05 | 0.04 | 7.31 | Vibration observed |

The form of the soft magnetic powder particles to be used in the present invention has no particular restriction. However, the present inventors have found that flattened soft magnetic powder particles having a ratio (d/t) of the mean particle size d to the thickness t of not less than 4 is effective for improving the magnetic permeability of the green compact (JP-A-No. 260114/1996). Thus, such a form may be effectively applied to the powder particles each coated with an insulating layer to be used in the present invention in order to further improve the magnetic properties of the green compact.

Figure 8:
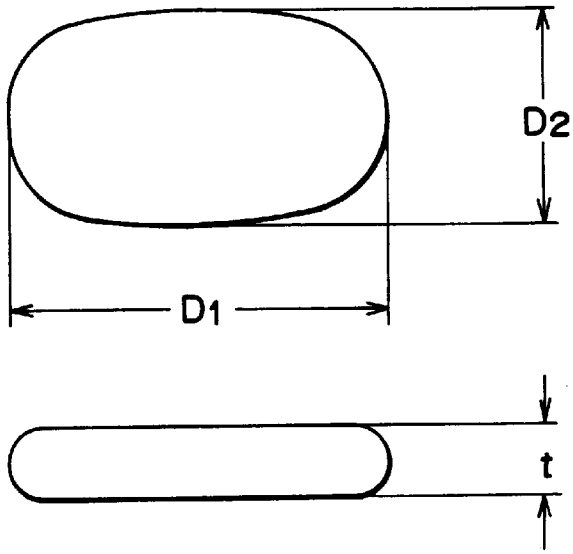
FIG. 8 is a schematic illustrative diagram showing the particle form after flattening.

Namely, the ratio of the mean particle size d to the thickness t after flattening is the value obtained by dividing the man value [(D1+D2)/2 of D1 and D2 by the thickness t, wherein D1 and D2 denote the major diameter and the minor diameter of a particle after flattening, respectively, and [D1+D2]/2] is a mean particle size as shown in FIG. 8. Evenwhen the insulated powder flattened so that the value is not less than 4 was used to be compacted, it was possible to further improve the magnetic properties of the green compact.

Incidentally, for flattening the powder, there can be adopted a twin roll, Attoritor, a rod mill, a vibration ball mill, and the like. A dry vibration mill not requiring a drying step of the powder, and having a high time efficiency is preferably adopted in terms of productivity.

The present invention is constituted as described above, whereby it was possible to manufacture a green compact which has attained high density and high strength, is excellent in mechanical properties and magnetic properties, and does not cause a reduction in electrical resistance.

What is claimed is:

1. A method for the compaction of a soft magnetic powder, comprising:

applying a lubricant to the inner wall surface of a compaction die, filling the compaction die with the soft magnetic powder subjecting the soft magnetic powder to compaction at from not less than room temperature to less than 50° C. without mixing the lubricant with the soft magnetic powder, and annealing a resulting green compact at from 50 to 300° C., particles of the soft magnetic powder being individually surface-coated with an insulating vitreous layer containing P, Mg, B, and Fe as essential components.

2. A method for the compaction of a soft magnetic powder, comprising:

applying a lubricant to the inner wall surface of a compaction die, and filling the compaction die with the soft magnetic powder subjecting the soft magnetic powder to compaction at from not less than 50° C. to less than 250° C. without mixing the lubricant with the soft magnetic powder, particles of the soft magnetic powder being individually surface-coated with an insulating vitreous layer containing P, Mg, B, and Fe as essential components.

3. The compaction method according to claim 1, wherein the pressure at the time of compaction is from 250 to 1500 Mpa.

4. The compaction method according to claim 2, wherein the pressure at the time of compaction is from 250 to 1500 Mpa.

5. The compaction method according to claim 1, wherein the maximum pressure at the time of compaction is set at from 500 to 1500 MPa.

vibrations are applied to the compaction die, the vibration in a pressure-free condition is set to have a single amplitude of 0.002 to 0.20 mm, and the amplitude of the vibration for all or a part of the pressing time during which the compaction pressure is not less than 500 MPa is not less than 20% of the amplitude in the pressure-free condition.

6. The compaction method according to claim 2, wherein the maximum pressure at the time of compaction is set at from 500 to 1500 Mpa, vibrations are applied to the compaction die, the vibration in a pressure-free condition is set to have a single amplitude of 0.002 to 0.20 mm, and the amplitude of the vibration for all or a part of the pressing time during which the compaction pressure is not less than 500 MPa is not less than 20% of the amplitude in the pressure-free condition.

7. The compaction method according to claim 5, wherein the frequency of the vibration is from 5 Hz to 20 kHz.

8. The compaction method according to claim 6, wherein the frequency of the vibration is from 5 Hz to 20 kHz.

9. The compaction method according to claim 1, wherein the magnetic powder has a ratio (d/t) of the mean particle size (d) to the thickness (t) of not less than 4.

10. The compaction method according to claim 2, wherein the magnetic powder has a ratio (d/t) of the mean particle size (d) to the thickness (t) of not less than 4.

* * * * *